US005404209A

United States Patent [19]

Matsuoka et al.

[11] Patent Number: 5,404,209

[45] Date of Patent: Apr. 4, 1995

[54] APPARATUS AND METHOD FOR FORMING IMAGES WHICH ARE TREATED WITH AN OIL ABSORBENT

[75] Inventors: Hirotaka Matsuoka; Takako Kobayashi; Ken Hashimoto, all of Minami Ashigara, Japan

[73] Assignee: Fuji Xerox Co., Ltd., Tokyo, Japan

[21] Appl. No.: 178,405

[22] Filed: Jan. 6, 1994

[30] Foreign Application Priority Data

Jan. 13, 1993 [JP] Japan ..... 5-019490

[51] Int. Cl.[6] ..... G03G 15/10

[52] U.S. Cl. ..... 355/256; 15/3; 34/95; 34/335; 34/336; 118/652; 118/659; 134/7; 430/118

[58] Field of Search ..... 355/256, 296; 118/652, 118/659, 660, 661; 430/33, 117, 118; 15/3; 134/6, 7; 34/95, 329, 335, 336

[56] References Cited

U.S. PATENT DOCUMENTS

| | | | |
|---|---|---|---|
| 3,656,948 | 4/1972 | Mammino | 430/117 |
| 3,697,263 | 10/1972 | Mammino | 430/117 |
| 4,065,304 | 12/1977 | Johnston et al. | 430/33 X |
| 4,126,101 | 11/1978 | Yamamoto | 118/661 |
| 4,582,774 | 4/1986 | Landa | 430/126 |
| 4,766,462 | 8/1988 | Dyer et al. | 355/256 |
| 5,023,665 | 6/1991 | Gundlach | 355/256 |

FOREIGN PATENT DOCUMENTS

| | | | |
|---|---|---|---|
| 45-27081 | 9/1970 | Japan . | |
| 49-30382 | 3/1974 | Japan . | |
| 49-128891 | 12/1974 | Japan . | |
| 50-15882 | 2/1975 | Japan . | |
| 50-29478 | 3/1975 | Japan . | |
| 50-59486 | 5/1975 | Japan . | |
| 51-6243 | 1/1976 | Japan . | |
| 52-76287 | 6/1977 | Japan . | |
| 53-99274 | 8/1978 | Japan . | |
| 54-47887 | 4/1979 | Japan . | |
| 54-100572 | 8/1979 | Japan . | |
| 54-159387 | 12/1979 | Japan . | |
| 57-2364 | 1/1982 | Japan . | |
| 57-101035 | 6/1982 | Japan . | |
| 58-199041 | 11/1983 | Japan . | |
| 60-8033 | 2/1985 | Japan . | |
| 62-49363 | 3/1987 | Japan . | |
| 62-49914 | 3/1987 | Japan . | |
| 1-270992 | 10/1989 | Japan . | |
| 2-230275 | 9/1990 | Japan | 355/256 |
| 3-221582 | 9/1991 | Japan . | |

OTHER PUBLICATIONS

K. A. Metcalfe et al., "Fine Grain Development In Xerography", Journal of Scientific Instruments, vol. 33, May 1956, pp. 194–195.

K. A. Metcalfe et al., "Laboratory and Workshop Notes," Journal of Scientific Instruments, vol. 32, Feb., 1955, pp. 74–75.

*Primary Examiner*—William J. Royer

*Attorney, Agent, or Firm*—Oliff & Berridge

[57] ABSTRACT

A method for forming images including the steps of: developing an electrostatic latent image formed on a latent image carrying member with a liquid developer including a carrier liquid; and bringing a toner image thus formed into contact with an oil absorbent selected from the group consisting of a network-forming oil-absorbent material and a gel-swelling oil-absorbent material, to remove the carrier liquid.

13 Claims, 4 Drawing Sheets

APPARATUS AND METHOD FOR FORMING IMAGES WHICH ARE TREATED WITH AN OIL ABSORBENT

FIELD OF THE INVENTION

The present invention relates to a method for forming images by a wet developing system, and more particularly to a method for forming images in which toner images formed by use of a liquid developer are treated with an oil absorbent.

BACKGROUND OF THE INVENTION

As a wet developing system in electrophotography, a process is generally known which comprises giving charges and image exposure on a photosensitive member to form electrostatic latent images, developing the images with a liquid developer comprising, for example, an aliphatic hydrocarbon carrier and toner particles dispersed therein which contains a resin and a colorant as main components, transferring the resulting toner images to a transfer paper sheet, and fixing them, thereby forming images. FIG. 1 shows a schematic construction of an example of an apparatus for conducting such a process. Referring to FIG. 1, a photosensitive member 101 is uniformly charged by use of charging corotrons 102, and an exposure device 103 provides image exposure thereon to form latent images, followed by contact with a liquid developer contained in a developing unit 104, thereby developing the latent images. The toner images thus formed are then transferred to a transfer paper sheet 106 with a transfer corotron 107, and fixed with fixing unit 108. Charges and toner particles remaining on the photosensitive member 101 are removed by means of an eraser lamp 109, a cleaning roll 110 and a cleaning blade 111, making preparations for the next cycle. The reference numeral 105 indicates a metering roll.

When photosensitive paper or a photosensitive film coated with a photoconductive material such as zinc oxide or titanium oxide is used as the photosensitive member, the transfer procedure in the above-described process may be omitted to directly fix the formed toner images on the photosensitive member after development.

Also when a liquid developer is used as a developing means in an electrostatic recording system in which electrostatic latent images are formed on a dielectric member by electric input without using the photosensitive member, the latent images are transferred and fixed in a manner similar to the above.

In a wet developing system, fine toner particles having a size of submicrons to several microns are dispersed in a carrier liquid having a high electric resistance such as an aliphatic hydrocarbon compound, and electrostatic latent images are developed mainly based on the principle of electrophoresis. This system therefore has the feature that high resolution image quality is easily obtained rather than in a dry developing system in which toner particles having a size of more than several microns are used. Two early literatures introduced by K. A. Metcalfe (*J. Sci. Instrum.*, vol. 32, 74 (1955), and ibid., vol. 33, 194 (1956)) disclose that a number of organic and inorganic pigments, including carbon black and magnesium oxide, can be used as pigments (toners) in liquid developers, and that gasoline, kerosine, carbon tetrachloride, etc. can be used as carrier liquids.

Metcalfe's early patents also disclose that halogen-containing hydrocarbons (as described in JP-B-35-5511, the term "JP-B" as used herein means as "examined Japanese patent publication), polysiloxanes (as described in JP-B-36-14872), and ligroin and mixtures thereof with petroleum hydrocarbons (as described in JP-B-38-22343 and JP-B-43-13519) can be used as carrier liquids. Many descriptions of carrier liquids are found in patents relating to toner producing methods (as described, e.g., in JP-B-40-19186, JP-B-45-14545 and JP-B-56-9189). These literatures describe that aromatic hydrocarbons such as toluene, xylene and benzene, and aliphatic hydrocarbons such as esters, alcohols, n-hexane, isododecane and Isopar H, G, L and V manufactured by Exxon Chemical Co. can be used as carrier liquids which sometimes act as dispersing media for polymerization of toner particles. However, these carrier liquids previously proposed are organic solvents having a high vapor pressure, and therefore have the problems in that: (i) vapor of the carrier liquids discharged on fixing is liable to cause environmental pollution, and (ii) the carrier liquids are flammable.

In order to solve these problems, for example, it is proposed to use hydrocarbon-series petroleum solvents that are low in vapor pressure for preventing vapor of the carrier liquids from being generated. However, an increase in the molecular weight of the hydrocarbons for the purpose of lowering the vapor pressure generally causes an increase in the viscosity of the carrier liquids, which results in an adverse effect on the rate of development. Further, the melting point of the carrier liquids is elevated to near room temperature, which requires continuous heating for using them in the liquid developers. This is unfavorable in terms of energy saving, heat pollution and deterioration of the developers.

Furthermore, the use of the carrier liquids having a low vapor pressure in the liquid developers causes penetration of excess carrier liquids into transfer paper. Accordingly, the problems of image quality arise that non-image parts become transparent and that stains due to the carrier liquids are liable to be produced.

In order to solve these problems, a liquid developer is proposed in which an oil coagulating agent is added to the insides of toner particles to adsorb a carrier liquid by heat on fixing (as described in JP-A-62-49363, the term "JP-A" as used herein means an "unexamined published Japanese patent application). In this case, however, the carrier liquid can only be absorbed in the vicinity of toner images, and can not be satisfactorily absorbed over the whole region on a transfer paper sheet. Furthermore, the oil coagulating agent described in JP-A-62-49363 does not generally dissolve in a toner binder, resulting in a decrease in the strength of fixed toner images or exertion of an adverse effect on toner electrification. In addition, the problem is also encountered that the resolution is decreased by absorption of the carrier liquid. Thus, satisfactory results have not been obtained yet.

As described above, with respect to the carrier liquids for liquid developers previously proposed, no means which can fully meet recent environmental regulations, or which fundamentally reduces the amount of carrier liquids discharged from copying machines or printers using liquid developers has been obtained yet.

SUMMARY OF THE INVENTION

An object of the present invention is to provide a method for forming images in which the amount of carrier liquids discharged from copying machines or printers using liquid developers can be reduced and the danger of fires is decreased.

Another object of the present invention is to provide a method for forming images in which problems do not arise that non-image parts of transfer paper become transparent and that stain-like image noises due to the carrier liquids are produced.

Other objects and effects of the present invention will be apparent from the following description.

The present inventors have conducted intensive investigation to reduce the amount of carrier liquids discharged from copying machines or printers using liquid developers to obtain liquid developers which do not violate the environment. As a result, the present inventors have discovered that the amount of carrier liquids discharged from copying machines or printers using liquid developers is substantially reduced by bringing the carrier liquids contained in toner images into contact with oil-absorbents, such as acrylic resins crosslinked to low density or norbornene resins crosslinked to low density, to solidify the carrier liquids, and recovering the solidified products, thus completing the present invention.

The present invention provides, as one aspect, a method for forming images comprising the steps of: developing an electrostatic latent image formed on a latent image carrying member with a liquid developer comprising a carrier liquid; and bringing a toner image thus formed into contact with an oil absorbent selected from the group consisting of a network-forming oil-absorbent material and a gel-swelling oil-absorbent material (oil-absorbent polymer), to remove the carrier liquid.

The present invention also provides, as another aspect, a method for forming images comprising the steps of: developing an electrostatic latent image formed on a latent image carrying member with a liquid developer comprising a carrier liquid; transferring a toner image thus formed to a transfer member; and bringing the toner image thus transferred into contact with an oil absorbent selected from the group consisting of a network-forming oil-absorbent material and a gel-swelling oil-absorbent material (oil-absorbent polymer), to remove the carrier liquid.

The present invention also provides, as further aspect, a method for forming images comprising the steps of: developing an electrostatic latent image formed on a latent image carrying member with a liquid developer comprising a carrier liquid; and transferring a toner image thus formed to a substrate containing an oil absorbent selected from the group consisting of a network-forming oil-absorbent material and a gel-swelling oil-absorbent material (oil-absorbent polymer).

As the oil absorbent, a gel-swelling oil-absorbent material (oil-absorbent polymer) is preferably used in the present invention, with a crosslinked acrylic resin and a crosslinked norbornene resin being particularly preferred.

The carrier liquid preferably has a vapor pressure of 1 Torr or less at 25° C., or a boiling point of 170° C. or more at 1 atm.

The present invention also provides, as still further aspect, an image forming device comprising: an image carrying member for carrying an electrostatic latent image; a means for developing the latent image, the developing means including a liquid developer comprising a carrier liquid; and a means for removing the carrier liquid from the liquid developer thus-developed by contacting with the carrier liquid, the removing means including an oil absorbent selected from the group consisting of a network-forming oil-absorbent material and a gel-swelling oil-absorbent material.

DETAILED DESCRIPTION OF THE INVENTION

Figure 1:
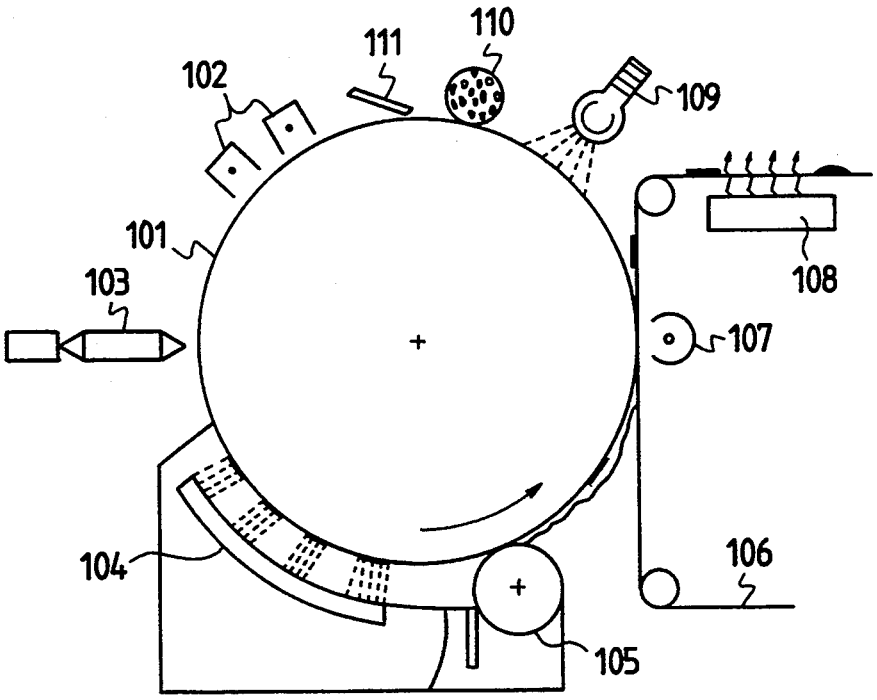
FIG. 1 is a schematic view for illustrating a developing system using a liquid developer.

Although nonwoven fabrics, etc. were formerly employed as oil-absorbent materials for absorbing oily products, the development of new materials has recently been advanced. The currently available oil-absorbent materials are classified into three types as follow according to the mechanism of oil absorption:

(1) The first type is a porous oil-absorbent material which includes fibers and inorganic or organic porous materials into voids of which oil is allowed to be physically absorbed by capillarity. Examples thereof include peat moss, polypropylene nonwoven fabric mats, cabot fibers, clay, active carbon, sellaite, etc., as described, e.g., in JP-A-49-30382, JP-A-49-128891, JP-A-50-29478, JP-A-51-6243, JP-A-52-76287, JP-A-57-2364, JP-A-53-99274, JP-A-54-47887, JP-B-60-8033, JP-A-54-100572, JP-A-54-159387, JP-B-61-33602, JP-A-57-101035, JP-A-58-199041 and JP-A-62-49914.

(2) The second type is a network-forming oil-absorbent material which includes low molecular weight gelling agents which form networks in oils to cause increased viscosity and gelation of oils, such as metallic soap, 12-hydoxystearic acid, N-acylamino acid amides and esters, and dibenzylidene D-sorbitol described, e.g., in JP-A-1-270992.

(3) The third type is a gel-swelling oil-absorbent material which includes low-crosslinked polymers having a high affinity for oil or solvents, which entrap oils therein to swell themselves.

In the present invention, the network-forming oil-absorbent material (2) and the gel-swelling oil-absorbing material (3) can be used, and the gel-swelling oil-absorbent material (3) is preferably used, because the gel-swelling oil-absorbent material effectively absorbs carrier liquids and can be regulated in the evaporation rate of carrier liquids. The network-forming oil-absorbent material (2) and the gel-swelling oil-absorbent material (3) may be porous by themselves to additionally have the function of the porous oil-absorbent material (1).

The gel-swelling oil-absorbent material (3) is referred to as an oil-absorbent polymer in the following description.

Examples of the oil-absorbent polymers include some of the synthetic resin series oil absorbents which have hitherto been reported. In particular, a crosslinked acrylic resin or a crosslinked norbornene resin having the following specific chemical structures can be advantageously used.

More specifically, acrylic resins described, for example, in JP-B-45-27081, JP-A-50-15882 and JP-A-50-59486 can be used. Examples thereof include resins obtained by copolymerizing t-butyl methacrylate or neopentyl methacrylate with a vinyl monomer copolymerizable therewith such as styrene, vinyltoluene, α-methylstyrene, methyl methacrylate, methyl acrylate, acrylonitrile, methacrylonitrile, vinyl chloride or vinyl acetate, in the presence of a crosslinking agent having at least two polymerizable unsaturated groups per molecule, such as divinylbenzene, ethylene glycol di(meth)acrylate, di(meth)acryl phthalate or di(meth)allyl maleate.

The term "(meth)acryl" and the like used herein means "acryl and methacryl" and the like.

Further, a self-swelling (meth)acrylic polymer as described in JP-A-3-221582 can be used, which comprises a (meth)acrylate of a monohydric aliphatic alcohol having one polymerizable unsaturated group and 10 to 16 carbon atoms represented by formula (A), and a crosslinkable monomer component having at least two polymerizable unsaturated groups in its molecular chain, such as ethylene glycol di(meth)acrylate, diethylene glycol di (meth) acrylate, polyethylene glycol di(meth)acrylate or polypropylene glycol di(meth)acrylate.

$$CH_2{=}CR_1{-}COOR_2 \qquad (A)$$

wherein $R_1$ represents hydrogen or a methyl group, and $R_2$ represents an aliphatic hydrocarbon group preferably having 10 to 16 carbon atoms. In formula (A), the carbon number of $R_2$ is preferably 10 to 16, because a carbon number of less than 10 tends to give a crosslinked polymer insufficient in oil-absorbent property, and a carbon number of more than 16 tends to provide a crosslinked polymer extremely low in oil-absorbent property at room temperature because of high crystallinity of its side chains.

Furthermore, a polynorbornene oil absorbent crosslinked to low density (as described in JP-B-45-27081) may be used.

It is considered that the essential reason why these resins exhibit the function of absorbing or retaining the carrier liquids is that the resins have the structure that monomers having affinity for the carrier liquids are crosslinked to low density. Various structures of gels composed of the resins and the carrier liquids contained therein are considered to govern the characteristics of swelling by absorption of the carrier liquids and contracting by discharge of the carrier liquids contained in the gels. For example, chemical structure or steric structure of the monomers constituting the high polymer gels; the molecular weight or molecular weight distribution between crosslinked points; structure of the crosslinked points, e.g., covalent bonds or ionic bonds; and ununiformity of network chain density due to crosslinking of the polymers are considered to govern the above-described characteristics. In order to largely exhibit the oil absorbing and oil retaining properties, it is necessary to increase the swelling degree of the polymers in the carrier liquids. It is unfavorable to increase the crosslinking degree too high, thereby forming solid rigid polymers. Thus, a low crosslinking density in a state a little before the polymers are dissolved in the carrier liquids to show a liquid state is considered to be preferred.

The oil absorbent used in the present invention preferably has an oil absorbing ratio of 4 times or more, and more preferably 10 times or more. There is no upper limit of the oil absorbing ratio of the oil absorbent, and is practically about 30 times or less from the standpoint of commercially available oil absorbents. The term "oil absorbing ratio" used herein means the number of unit weight of an oil (carrier liquid) absorbed by unit weight of an oil absorbent.

The manner by which the oil absorbent is made in contact with a carrier liquid is described below. The description mainly refers to an oil-absorbent polymer, but it is not construed as being limited thereto.

The oil-absorbent polymers used in the present invention may be either brought into contact with toner images as such, or used in various processed forms. For example, oil-absorbent polymer particles may be dusted or coated on fabrics to bring them into contact with toner images.

In the present invention, electrostatic latent images formed on a latent image carrying member are first developed with a liquid developer comprising a carrier liquid. This step can be conducted by known processes. Then, (a) the toner images formed are brought into contact with an oil absorbent to remove the carrier liquid, or (b) the toner images formed are transferred to a transfer member, and the toner images transferred are brought into contact with an oil absorbent to remove the carrier liquid, or (c) the toner images formed are transferred to a substrate containing an oil absorbent, thereby forming the images.

Examples of the method for making the oil absorbent into contact with a carrier liquid (first through fourth methods) are described below.

I. The first method is a method in which particles of an oil-absorbent polymer are directly cascaded on toner images (developed images) directly developed on photoconductive photosensitive paper or toner images (transferred images) transferred from an electrophotographic photosensitive member onto an intermediate transfer member or transfer paper, so as to absorb a carrier liquid contained in the toner images. According to this method, adhesion of the carrier liquid to the paper can be preferably reduced to obtain better images, by absorbing the carrier liquid particularly on the toner images on the photosensitive member. The polymer after oil absorption is recovered, and it is also possible to recover the carrier liquid from the polymer to recycle the polymer, as so desired.

Figure 2:
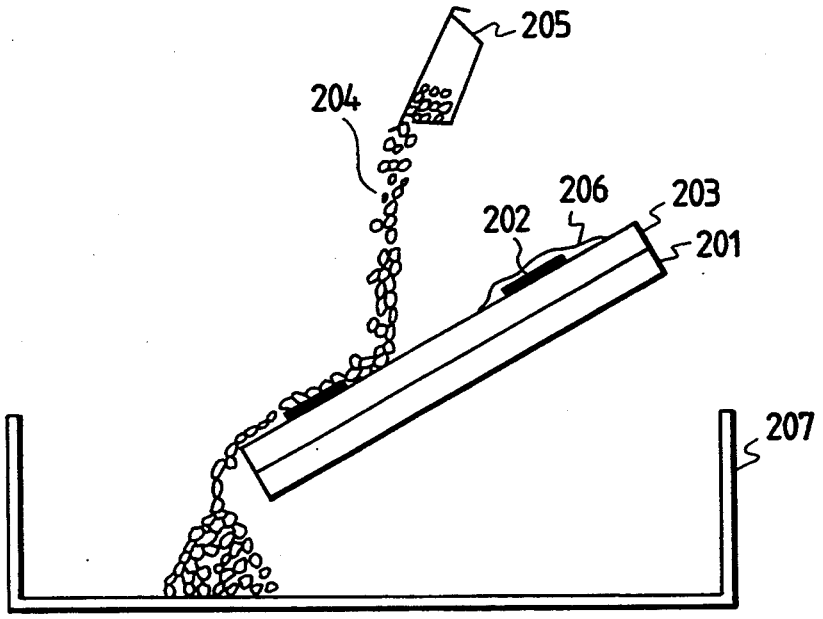
FIG. 2 is a schematic view for illustrating one oil absorbing process embodying the present invention.

FIG. 2 is a view for illustrating one embodiment of the first method. Photosensitive paper or transfer paper 203 on which toner images 202 are formed is placed on a substrate 201, and oil-absorbent polymer particles 204 are cascaded thereon from a container 205 to allow a carrier liquid 206 existing in the toner images and on a surface of the photosensitive paper or transfer paper to be absorbed. The polymer particles which have absorbed the carrier liquid are recovered in a recovery container 207.

II. A second method is a method in which particles of an oil-absorbent polymer is supplied on a surface of a roll, carried and regulated with a blade to form a polymer layer, followed by contact with developed images or transferred images to absorb a carrier liquid. The oil-absorbent polymer exhibits that self-swelling is induced by absorption of the carrier liquid to increase its volume greatly, whereby the flowability of the polymer is improved or the cohesive force between molecules of the polymer is lowered, resulting in easy handling when recovered and recycled.

Figure 5A:
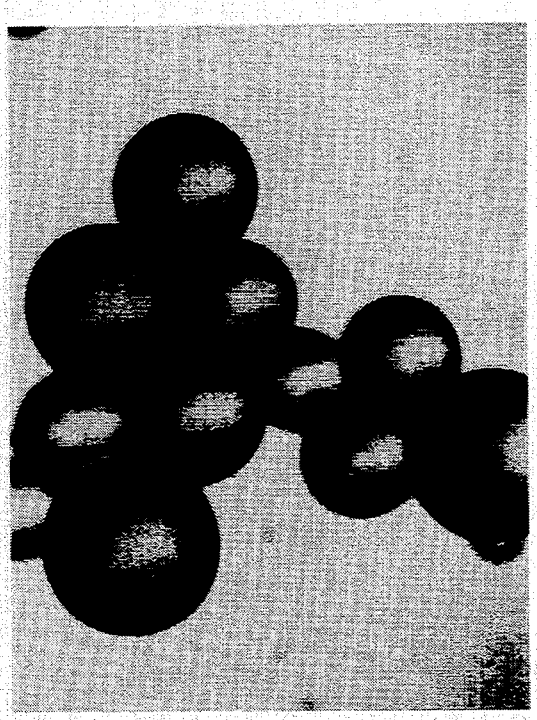
FIGS. 5 (*a*) and 5 (*b*) are photomicrographs showing the shape of oil-absorbent polymer particles before oil absorption.
Figure 5B:
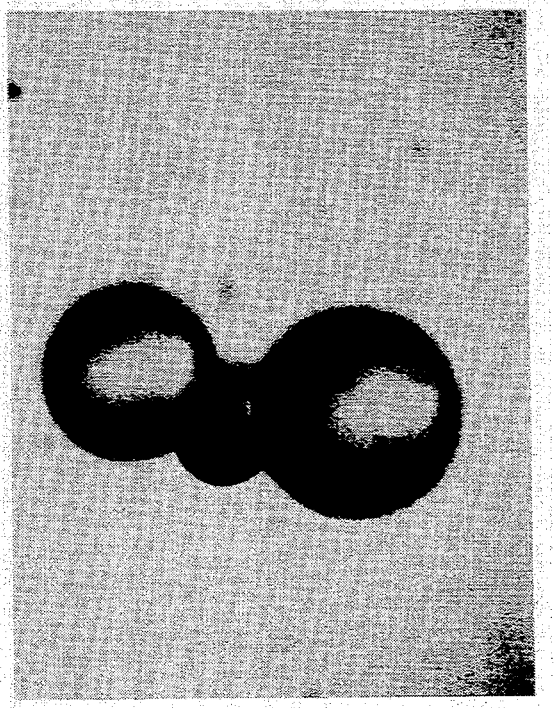
Figure 6A:
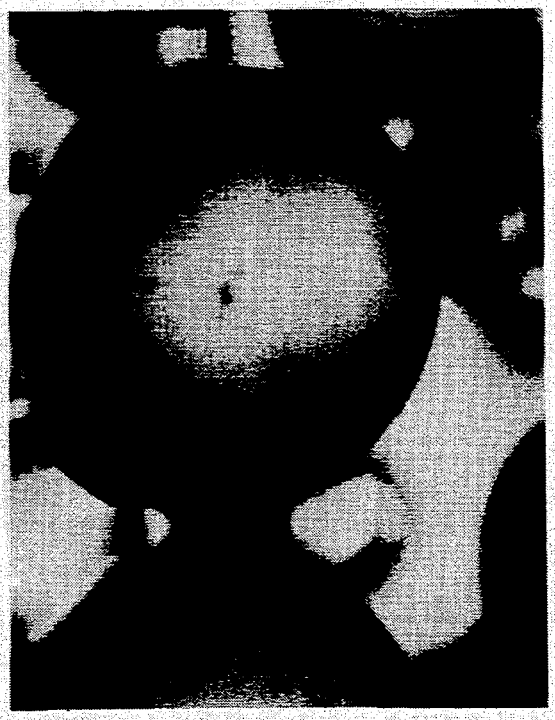
FIGS. 6 (*a*) and 6 (*b*) are photomicrographs showing the shape of oil-absorbent polymer particles after oil absorption.
Figure 6B:
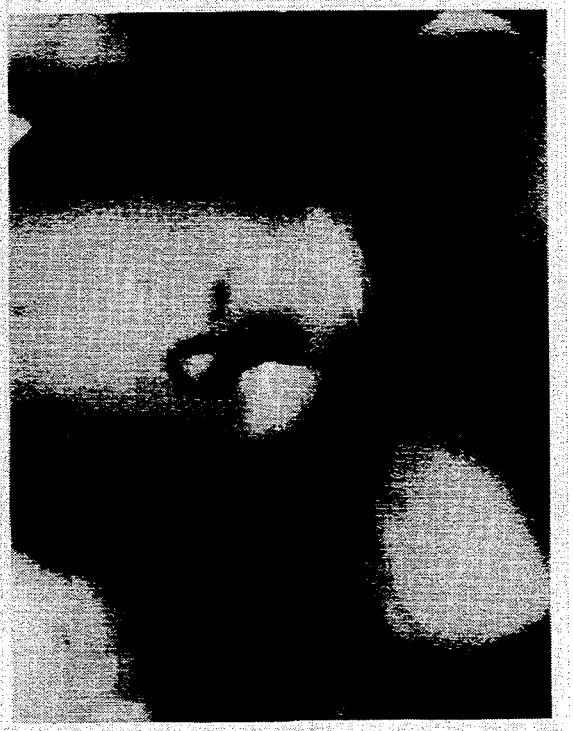

FIGS. 5 (*a*) and 5 (*b*) are photomicrographs (magnification: 80) showing an example of the shape of oil-absorbent polymer particles before oil absorption. FIGS. 6 (*a*) and 6 (*b*) are photomicrographs (magnification: 80) showing an example of the shape of oil-absorbent polymer particles after oil absorption. For these photomicrographs, Isopar L (manufactured by Exxon Chemical Co.) was used as the carrier liquid, and a resin employed in Example 1 described below was used as the oil-absorbent polymer. The carrier liquid was absorbed by the oil-absorbent polymer at a carrier to oil-absorbent ratio (by weight) of 1/1.

Figure 3:
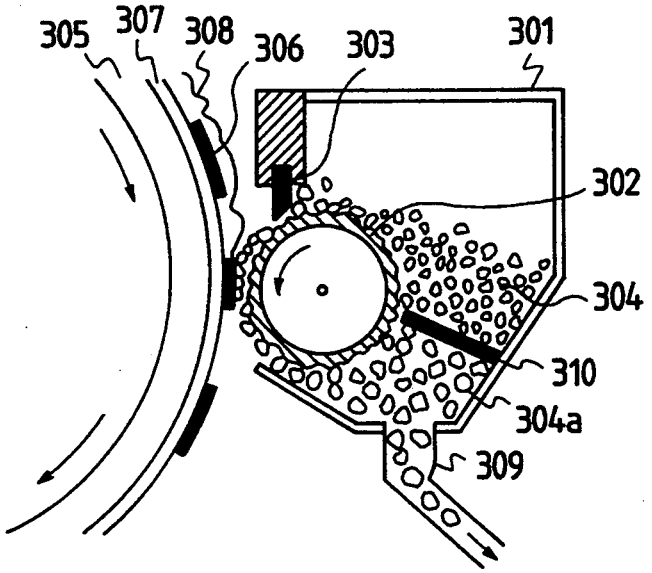
FIG. 3 is a schematic view for illustrating another oil absorbing process embodying the present invention.

FIG. 3 is a schematic view for illustrating one embodiment of an apparatus for conducting the second method. Oil-absorbent polymer particles 304 are formed in layer form on an uneven surface of a carrier roll 302 rotatably placed in a hopper 301 with a blade 303, carried, and brought into contact with photosensitive paper or transfer paper 307 bearing toner images 306 placed on a substrate 305 to allow a carrier liquid 308 existing in the toner images and on a surface of the photosensitive paper or transfer paper to be absorbed. Polymer particles 304*a* swelled by absorbing the carrier liquid are discharged from an outlet 309, and sent to a recovery apparatus (not shown) for recovery. The reference numeral 310 designates a scraper, which acts so as to separate the polymer particles after oil absorption from the carrier roll, and to isolate them from the polymer particles before soil absorption.

In the first and second methods, the oil absorbent is used in the form of particles generally having a diameter of from 0.05 to 1,000 μm, and preferably from 0.1 to 500 μm. The particle diameter varies depending on the production method for the oil absorbent. For example, suspension polymerization generally provides a diameter of from 10 to 1,000 μm, and emulsion polymerization generally provides a diameter of from 0.1 to 3 μm.

Figure 4:
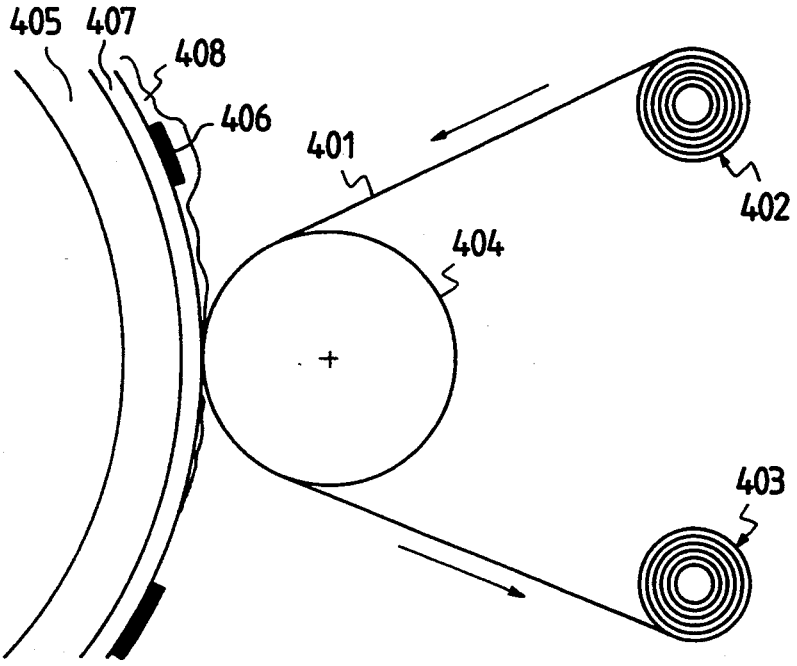
FIG. 4 is a schematic view for illustrating a further oil absorbing process embodying the present invention.

III. The third method is a method in which a film, a cloth or a sponge which is formed of an oil-absorbent polymer itself or on which an oil-absorbent polymer is dusted or coated is brought into contact with developed images or transferred images to absorb and recover a carrier liquid. FIG. 4 is a view for illustrating one embodiment of the third method. A film or web 401 on which the oil-absorbent polymer is dusted or coated is taken up through a contact roll 404 between scrolls 402 and 403. The film or web 401 is brought into contact with photosensitive paper or transfer paper 407 bearing toner images 406 placed on a substrate 405 by means of the contact roll, thereby allowing a carrier liquid 408 existing in the toner images and on a surface of the photosensitive paper or transfer paper to be absorbed.

IV. The fourth method is a method in which an oil-absorbent polymer is previously dusted or coated on an substrate such as transfer paper or an OHP film, on which final images are formed, to allow the oil-absorbent polymer to be contained in the substrate, and toner images formed by development are transferred onto the substrate, thereby forming fixed images.

In any of the first to fourth methods, more effective absorption of a carrier liquid can be attained by previously reducing excess amounts of a carrier liquid with mechanical means such as squeeze rolls, a blade, a sponge, a felt, an air knife or a suction method.

Among the above first to fourth methods, the seconds, third and fourth methods are preferably employed in the present invention, with the third and fourth methods being more preferred. The fourth method is particularly preferred if used in combination with the first, second or third method.

Oil absorbents which have conventionally been used in the art for treatment of waste oils or leakage oils, for example, natural plant oil absorbents such as pulp, beets and cotton, inorganic° oil absorbents obtained by water-repellent treating inorganic porous powders such as lime, silica and barite, synthetic fiber oil absorbents such as polypropylene fibers, polyethylene fibers and polystyrene fibers, expanded resin oil absorbents such as expanded polyurethane foam, adsorb and retain oil in their voids or pores. On the other hand, the oil-absorbent polymers entrap oils in networks of crosslinked polymer chains to form gels. Accordingly, when used in copying machines or printers, the oil-absorbent polymers have the following features:

(i) After contact with toner images, the oil-absorbent polymers can spontaneously absorb carrier liquids without any external force, such as heat, light or electricity, to form gels.

(ii) The carrier liquids contained in the toner images are easily absorbed by the oil-absorbent polymers even at room temperature, and the oil absorbency and gelation can be further enhanced by external heating such as heat fixing.

(iii) The evaporation rate of the carrier liquids is considerably lowered after gelation, which substantially prevents the carrier liquids from being evaporated and discharged from print images.

Furthermore, unlike the conventional oil-absorbent materials which absorb and retain oil in voids or pores such as a porous oil-absorbent material, it does not happen that the carrier liquids are discharged from the oil-absorbent polymers by dynamic stress such as application of pressure. The oil-absorbent polymers therefore also have an advantageous feature that the carrier liquids can be very stably, efficiently prevented from being discharged.

According to the above-described function and mechanism, the oil-absorbent polymers are also effective for a reduction in the amount of the carrier liquids discharged from copying machines, printers, etc. and for prevention of evaporation of the carrier liquids after printing.

Upon conducting oil absorption, the oil absorbent is preferably used in such an amount that the oil absorbent is uniformly in contact with a carrier liquid in an amount smaller than that absorbed by the oil absorbent. More specifically, the preferred minimum amount of the oil absorbent can be calculated by the following formula. The oil absorption area is generally equal to an image area.

Minimum oil absorbent amount (g)=Oil absorption area×Average oil thickness×Specific gravity of oil×1/Oil absorption ratio In the present invention, the carrier liquids which can be absorbed and allowed to gel by use of the oil absorbents such as these oil-absorbent polymers include carrier liquids previously known in the art. For example, branched chain aliphatic hydrocarbons such as Isopar H, G, L, M and V manufactured by Exxon Chemical Co., straight chain aliphatic hydrocarbons such as Norpar 14, 15 and 16 manufactured by Exxon Chemical Co., and hydrocarbon oils such as high insulation i-paraffin and n-paraffin can be used. Further, such carrier liquids include higher molecular wax-like hydrocarbons such as n-undecane, n-dodecane, n-tridecane, n-tetradecane, n-pentadecane, n-hexadecane, n-heptadecane, n-octadecane and n-nonadecane, halides thereof and fluorocarbons. In addition, aromatic hydrocarbon oils such as cyclohexane, decalin, alkylnaphthalenes, alkyldiphenyls and diphenyl ether can also be used.

Furthermore, dimethyl silicones such as silicone oils, phenylmethyl silicones obtained by partly substituting dimethyl silicones with phenyl groups, or modified silicone oils containing chlorophenyl groups, long-chain alkyl groups, trifluoroalkyl groups, amino groups, carboxyl groups, hydroxyl groups, etc. can be used.

The carrier liquids which can be used also include ethylene glycol, propylene glycol, butylene glycol, pentylene glycol, dialkyl esters of glycols such as diethylene glycol, dipropylene glycol, dibutylene glycol and dipentylene glycol, monoalkyl ether-monoesters, and dialkyl esters.

In order to exhibit the effect of the present invention more desirably and to obtain developers which do not violate the environment, it is preferred to use carrier liquids having a low vapor pressure. More specifically, carrier liquids having a vapor pressure of 1 Torr or less at 25° C. or a boiling point of 170° C. or more at 1 atm can be preferably used. While the treatment with the oil-absorbent polymers is sufficiently effective for a decrease in evaporation amount, in order to decrease the evaporation amount to almost zero, it is desirable that the vapor pressure or boiling point is within the range described above. Becoming transparent of paper in using these carrier liquids having a low vapor pressure and stain-like image noises due to the carrier liquids can be effectively prevented by using transfer paper on which the oil-absorbent polymers are dusted or coated.

The toner particles used in the present invention are not particularly limited and can be made predominantly from a pigmented material, such as a suitable resin. A suitable liquid developer material is described in U.S. Pat. No. 4,582,774, the relevant portions thereof being hereby incorporated into the present application.

The present invention is illustrated by the following examples and comparative examples. However, the following examples and comparative examples are intended to illustrate the invention concretely, but are not to be construed to limit the scope of the invention. All parts, percents and the like are by weight unless otherwise indicated.

Evaluation methods used in the following examples and comparative examples are as follows:

1. Method for Measuring Gelation Rate of Carrier Liquid with Oil-Absorbent Polymer and Evaporation Amount Thereof (A) Measurement of Evaporation Amount of Carrier Liquid:

Three grams of a carrier liquid was put into a glass dish having an open area of 78 $cm^2$. This dish was allowed to stand on a hot plate heated at a fixed temperature of 22° C. or 40° C. for 6 hours. Changes in the evaporation weight of the carrier liquid with time were determined by measuring with a precision balance. The evaporation rate of the carrier liquid is defined by equation (1):

$$\text{Evaporation rate (\%)} = \frac{\text{Weight of carrier liquid evaporated (g)}}{\text{Weight of carrier liquid at start (g)}} \times 100 \quad (1)$$

(B) Preparation of Gel of Carrier Liquid with Oil-Absorbing Polymer and Measurement of Evaporation Amount Thereof:

Specified amounts of an oil absorbent and a carrier liquid were placed in a glass dish having an open area of 78 $cm^2$, and allowed to stand at room temperature. After standing for a fixed period of time, the glass dish was slowly tilted to confirm visually that the carrier liquid was all entrapped in the polymer, thus preparing a gel of the carrier liquid. Further, the time when this gel had ceased to flow was judged to be a gel time. The evaporation rate of the carrier liquid after gelation was measured in the same manner as with the carrier liquid alone.

2. Measurement of Solvent Odor from Machine

A black toner containing developing unit and a fixing unit of a copying machine (FX-5030, manufactured by Fuji Xerox Co., Ltd. were modified to those for liquid development to construct a copying machine for liquid development. The copying machine was arranged in a manner that a back part of a paper sheet is heated with a heat roll and a front part thereof is fixed with an emery roll. Using a chart having an image area of 25%, copying was carried out in a monochrome color mode (15 sheets/minutes) for A4-size plain paper sheets. Sensory evaluation was carried out by 10 inspectors standing at the position where operators usually work, according to the following 4-step evaluation standard: 1: No odor of the carrier liquid is detected. 2: Odor of the carrier liquid is slightly detected. 3: Odor of the carrier liquid is considerably detected. 4: Odor of the carrier liquid is markedly detected.

The judgement was conducted based on the mean values of data evaluated by the 10 inspectors.

EXAMPLE 1

Preparation of Gel of Carrier Liquid:

A gel of a carrier liquid was prepared by the following procedure, and its characteristics of evaporation were evaluated.

| | |
|---|---|
| Oil Absorbent: | 10 parts |
| Particles of the crosslinked polymer resin of dodecyl acrylate and ethylene glycol diacrylate | |
| Carrier Liquid: | 10 parts |
| n-Tetradecane (guaranteed reagent, flash point: 99° C.) | |

The above-described composition was placed in a glass dish having an open area of 78 $cm^2$, and allowed to stand at room temperature. After standing for a fixed period of time, the glass dish was slowly tilted to confirm visually that the carrier liquid was all entrapped in the polymer. The time when this gel had ceased to flow on tilting was judged to be a gel time. The gel thus formed was allowed to stand on a hot plate heated at a fixed temperature of 22° C. or 40° C., while keeping the gel in the dish, and changes in the evaporation weight of the carrier liquid with time were measured with a precision balance. The evaporation rate of the carrier liquid after 6 hours was determined according to the above-described equation (1). Results are shown in Table 1.

EXAMPLE 2

| | |
|---|---|
| Oil Absorbent: Oleosorb SL-200 (low-crosslinked acrylic polymer, manufactured by Nippon Shokubai Co., Ltd.) | 10 parts |
| Carrier Liquid: n-Tetradecane (guaranteed reagent) | 10 parts |

Using the above-described composition, a gel was prepared in a glass dish in a manner similar to that of Example 1, and changes in evaporation weight on a hot plate heated at a fixed temperature were measured. Results are shown in Table 1.

The oil absorbents used in Examples 1 and 2 exhibit oil absorption ratios of about from 8 to 12 times for aliphatic hydrocarbons, about 15 times for aromatic hydrocarbons, about from 10 to 12 times for petroleum solvents, and about 25 times at most for halogen-containing hydrocarbons, but substantially no absorption for water-soluble solvents such as ethanol and acetone.

EXAMPLE 3

| | |
|---|---|
| Oil Absorbent: Polynorbornene resin particles | 10 parts |
| Carrier Liquid: n-Tetradecane (guaranteed reagent) | 10 parts |

Using the above-described composition, a gel was prepared in a glass dish in a manner similar to that of Example 1, and changes in evaporation weight on a hot plate heated at a fixed temperature were measured. Results are shown in Table 1.

EXAMPLE 4

A gel was prepared in the same manner as with Example 1, with the exception that Isopar L (Exxon Chemical Co., flash point: 61° C.) was employed as the carrier liquid, and its characteristics of evaporation were evaluated. Results are shown in Table 1.

EXAMPLE 5

A gel was prepared in the same manner as with Example 1, with the exception that diethylene glycol dibutyl ether (guaranteed reagent, flash point: 118° C.) was used as the carrier liquid, and its characteristics of evaporation were evaluated. Results are shown in Table 1.

COMPARATIVE EXAMPLES 1 TO 3

Using no oil absorbent, and using, as the carrier liquid, n-tetradecane, Isopar L and diethylene glycol dibutyl ether used in Examples 1 to 5, the characteristics of evaporation of the carrier liquids alone were evaluated in a manner similar to that of Example 1. Results are shown in Table 1.

TABLE I

| | Oil Absorbent | Carrier Liquid | Vapor Pressure (25°) (Torr) | Boiling Point (1 atm) (°C.) | Carrier Solution: Oil Absorbent (composition ratio by wt.) | Evaporation Rate of Carrier Solution after 6 Hours 22° C. (%) | 40° C. (%) |
|---|---|---|---|---|---|---|---|
| Example 1 | Dodecyl acrylate/ethylene glycol diacrylate copolymer resin particles | n-Tetradecane | 0.0095 | 253.5 | 50/50 | 0.12 | 0.9 |
| Example 2 | Oleosorb SL-200 | n-Tetradecane | 0.0095 | 253.5 | 50/50 | 0.15 | 1.1 |
| Example 3 | Polynorbornene resin particles | n-Tetradecane | 0.0095 | 253.5 | 50/50 | 0.17 | 1.2 |
| Example 4 | Dodecyl acrylate/ethylene glycol diacrylate copolymer resin particles | Isopar L | 0.8 | 168 (initial) 194 (50%) | 50/50 | 5.8 | 46 |
| Example 5 | Dodecyl acrylate/ethylene glycol diacrylate copolymer resin particles | Diethylene glycol dibutyl ether | 0.0076 | 254 | 50/50 | 0.19 | 1.55 |
| Comparative Example 1 | None | n-Tetradecane | 0.0095 | 253.5 | 100/0 | 0.24 | 1.8 |
| Comparative Example 2 | None | Isopar L | 0.8 | 168 (initial) 194 (50%) | 100/0 | 12 | 92 |
| Comparative Example 3 | None | Diethylene glycol dibutyl ether | 0.0076 | 254 | 100/0 | 0.6 | 4.6 |

As apparent from Table 1, the carrier liquids of Examples 1 to 3 are reduced in evaporation rate to about ½ to 1/1.4 at both temperatures of 22° C. and 40° C., compared with Comparative Example 1. The carrier liquid of Example 4 is also reduced in evaporation rate to about ½ at both temperatures of 22° C. and 40° C., compared with Comparative Example 2. The carrier liquid of Example 5 is also reduced in evaporation rate to about ⅓ at both temperatures of 22° C. and 40° C., compared with Comparative Example 3.

EXAMPLE 6 AND COMPARATIVE EXAMPLE 4

Paper coated with an oil-absorbent polymer was prepared through the following procedure.

| | |
|---|---|
| Oil Absorbent: Oleosorb EM-631 (low-crosslinked acrylic polymer, manufactured by Nippon Shokubai Co., Ltd., 30 wt % aqueous dispersion) | 5 parts |

-continued

| |
|---|
| Base Paper: Fuji Xerox L paper (A4 size) |

The oil absorbent was coated on the paper with a wire bar, and then air-dried at room temperature to prepare coat paper. One droplet of the carrier liquid (n-tetradecane) used in Example 1 was dropped on the coat paper, and the evaporation amount of the carrier liquid and the spreading thereof in the paper at 40° C. after 6 hours were measured on a hot plate in a manner similar to that of Example 1.

For comparison, a similar evaluation was carried out using untreated paper (Comparative Example 4). Results thereof are shown in Table 2.

EXAMPLE 7 AND COMPARATIVE EXAMPLE 5

A surface-treated OHP film was prepared in the same manner as with Example 6, with the exception that an OHP film was substituted for the paper to be coated in Example 6, and evaluated in the manner similar to that of Example 6.

For comparison, a similar evaluation was carried out using an untreated OHP film (Comparative Example 5). Results thereof are shown in Table 2.

TABLE 2

| | Paper | Carrier Liquid | Evaporation Rate of Carrier Liquid after 6 Hours (40° C.) (%) | Change in Dropped Image after 6 Hours |
|---|---|---|---|---|
| Example 6 | L paper coated with Oleosorb EM-631 | n-Tetradecane | 0.4 | No change from the initial stage (no penetration in the paper, no transparency problem) |
| Example 7 | OHP film coated with Oleosorb EM-631 | n-Tetradecane | 0.4 | No change from the initial stage (no penetration in the film, no transparency problem) |
| Comparative Example 4 | Untreated L paper | n-Tetradecane | 1.9 | Penetration in the paper, which becomes transparent |
| Comparative Example 5 | Untreated OHP film | n-Tetradecane | 1.8 | No change from the initial stage (undried) |

As apparent from Table 2, the evaporation rate of the carrier liquid on the coat paper used in Examples 6 and 7 is greatly decreased, compared with Comparative Examples 4 and 5.

EXAMPLE 8

A black toner containing developing unit and a fixing unit of a copying machine (FX-5030, manufactured by Fuji Xerox Co., Ltd. were modified to those for liquid development to construct a copying machine for liquid development. The copying machine was arranged in a manner that a back part of a paper sheet is heated with a heat roll and a front part thereof is fixed with an emery roll. An oil absorbing subsystem having the structure shown in FIG. 3 was installed next to a transfer unit of this copying machine for liquid development, and adjusted so that the excess carrier liquid on transfer paper could be absorbed.

Oil-absorbent polymer particles used were formed of the crosslinked polymer of hexadecyl methacrylate and divinylbenzene.

A developer was prepared using the following materials through the following procedure.

| | |
|---|---|
| Ethylene-methacrylic acid copolymer | 85 parts |
| Copper phthalocyanine | 15 parts |

The mixture of the above ingredients was put into 200 parts of Isopar L, followed by heating to dissolve it. After cooling, the particles precipitated were pulverized with an attritor to obtain toner particles having a diameter of 2.5 μm. To the toner was added 0.1 part by weight per part by weight of toner in the developer of BBP (basic barium petronate) as an antistatic agent, and the mixture was thoroughly stirred.

The resulting developer was placed in the copying machine modified to the liquid developer use, and continuous copying was conducted. The treatment of absorbing the carrier liquid on the transfer paper was evaluated at the same time. Paper used for copying was plain paper. Using a chart having an image area rate of 25%, 100 A4-size paper sheets were continuously copied at 15 cpm in a monochrome mode. Results are shown in Table 3.

EXAMPLE 9

Using the modified copying machine employed in Example 8, the continuous copying procedure was conducted in the same manner as with Example 8, with the exception that the crosslinked polymer of decyl acrylate and 1,6-hexanediol diacrylate was used as the oil-absorbent polymer, and evaluated. Results are shown in Table 3.

EXAMPLE 10

Using the modified copying machine employed in Example 8, the continuous copying procedure was conducted in the same manner as with Example 8, with the exception that the system the structure shown in FIG. 4 was installed as the oil absorbing system, and evaluated. The oil-absorbent web was produced by adhering a polypropylene nonwoven fabric sheet to a PET film as a substrate, and further dusting the oil-absorbent polymer thereon. Results are shown in Table 3.

EXAMPLE 11

Using the oil-absorbent system employed in Example 10, the continuous copying procedure was conducted in the same manner as with Example 10, with the exception that polynorbornene resin particles were used as the oil-absorbent polymer, and evaluated. Results are shown in Table 3.

EXAMPLE 12

Using the coat paper employed in Example 6 and the modified copying machine and the developer employed in Example 8, the copying procedure was conducted. As a result, output images had no blotting or no deformation of letter portions, and could satisfactorily stand comparison with untreated plain paper. The odor of the carrier liquid generated from the copying machine on continuous copying was on an utterly unconscious level. Results are shown in Table 3.

EXAMPLE 13

Using the coat paper employed in Example 6, the copying procedure was conducted in the same manner as with Example 8, with the exception that the roll carrier type oil absorbing subsystem of the modified copying machine in Example 8 was not used. As a result, output images had no blotting or no deformation of letter portions, and could satisfactorily stand comparison with untreated plain paper. Further, the odor of the carrier liquid generated from the copying machine on continuous copying was on an utterly unconscious level. Results are shown in Table 3.

COMPARATIVE EXAMPLE 6

The continuous copying procedure was conducted in the same manner as with Example 8, with the exception that the oil absorbing system employed in Example 8 was not used, and evaluated. Results are shown in Table 3.

TABLE 3

| | Oil Absorbing Subsystem | Oil-Absorbent Polymer | Paper Used | Solvent Odor from Copying Machine on Continuous Copying (grade) |
|---|---|---|---|---|
| Example 8 | Roll carrier method (FIG. 3) | Crosslinked polymer of hexadecyl methacrylate and divinylbenzene | Plain paper | 1 |
| Example 9 | Roll carrier method (FIG. 3) | Crosslinked polymer of decyl acrylate and 1,6-hexanediol acrylate | Plain paper | 1 |
| Example 10 | Web take-up method (FIG. 4) | Crosslinked polymer of hexadecyl methacrylate and divinylbenzene | Plain paper | 1 |
| Example 11 | Web take-up method (FIG. 4) | Polynorbornene particles | Plain paper | 1 |
| Example 12 | Roll carrier method (FIG. 3) | Crosslinked polymer of hexadecyl methacrylate and divinylbenzene | Coat paper* | 1 |
| Example 13 | None | — | Coat paper* | 1 |
| Comparative Example 6 | None | — | Plain paper | 3 |

*)Coated paper: L paper coated with Oleosorb EM-631 (see Example 6)

As apparent from Table 3, in all Examples 8 to 13, no odor of the carrier liquid was generated at all from the copying machine on continuous copying, and the resulting images had no deformation of letters, resulting in satisfactory image quality. In Comparative Example 6 in which the copying machine was not equipped with the oil absorbing system according to the present invention, the odor characteristic of a petroleum solvent was generated mainly from the vicinity of the fixing unit on continuous copying. Further, The transparency phenomenon due to the carrier liquid took place, which caused dim images.

As described above, the present invention relates to a method for forming images which comprises developing electrostatic latent images by use of a liquid developer, and a carrier liquid contained in the toner images is removed by use of an oil absorbent. The amount of the carrier liquid discharged from a copying machine or a printer can therefore be reduced, and the danger of fires is also decreased. Furthermore, when carrier liquids having a low vapor pressure are used, the problems do not arise that non-image parts of paper become transparent and that stain-like image noises due to the carrier liquids are produced.

While the present invention has been described in detail and with reference to specific examples thereof, it will be apparent to one skilled in the art that various changes and modifications can be made therein without departing from the spirit and scope thereof.

What is claimed is:

1. An image forming device comprising:

an image carrying member for carrying an electrostatic latent image;

a means for developing said latent image, said developing means including a liquid developer comprising a carrier liquid; and a means for removing said carrier liquid from said liquid developer thus-developed by contacting with said carrier liquid, said removing means including an oil absorbent selected from the group consisting of a network-forming oil-absorbent material and a gel-swelling oil-absorbent material.

2. A method for forming images comprising the steps of:

developing an electrostatic latent image formed on a latent image carrying member with a liquid developer comprising a carrier liquid; and bringing a toner image thus formed into contact with an oil absorbent selected from the group consisting of a network-forming oil-absorbent material and a gel-swelling oil-absorbent material, to remove said carrier liquid.

3. A method for forming images as claimed in claim 2, wherein said carrier liquid has a vapor pressure of 1 Torr or less at 25° C., or a boiling point of 170° C. or more at 1 atm.

4. A method for forming images as claimed in claim 2, wherein said oil absorbent is a gel-swelling oil-absorbent material.

5. A method for forming images as claimed in claim 4, wherein said gel-swelling oil-absorbent material is a crosslinked acrylic resin or a crosslinked norbornene resin.

6. A method for forming images comprising the steps of:

developing an electrostatic latent image formed on a latent image carrying member with a liquid developer comprising a carrier liquid;

transferring a toner image thus formed to a transfer member; and bringing said toner image thus transferred into contact with an oil absorbent selected from the group consisting of a network-forming oil-absorbent material and a gel-swelling oil-absorbent material, to remove the carrier liquid.

7. A method for forming images as claimed in claim 6, wherein said carrier liquid has a vapor pressure of 1 Torr or less at 25° C., or a boiling point of 170° C. or more at 1 atm.

8. A method for forming images as claimed in claim 6, wherein said oil absorbent is a gel-swelling oil-absorbent material.

9. A method for forming images as claimed in claim 8, wherein said gel-swelling oil-absorbent material is a crosslinked acrylic resin or a crosslinked norbornene resin.

10. A method for forming images comprising the steps of:

developing an electrostatic latent image formed on a latent image carrying member with a liquid developer comprising a carrier liquid; and transferring a toner image thus formed to a substrate containing an oil absorbent selected from the group consisting of a network-forming oil-absorbent material and a gel-swelling oil-absorbent material.

11. A method for forming images as claimed in claim 10, wherein said carrier liquid has a vapor pressure of 1 Torr or less at 25° C., or a boiling point of 170° C. or more at 1 atm.

12. A method for forming images as claimed in claim 10, wherein said oil absorbent is a gel-swelling oil-absorbent material.

13. A method for forming images as claimed in claim 12, wherein gel-swelling oil-absorbent material is a crosslinked acrylic resin or a crosslinked norbornene resin.

* * * * *